United States Patent [19]

Schmidt

[11] Patent Number: 4,573,223

[45] Date of Patent: Mar. 4, 1986

[54] AUTOMATIC TOILET TANK RELEASE

[76] Inventor: Richard B. Schmidt, Sky Harbour E. Apt. 2K, Fort Lauderdale, Fla. 33316

[21] Appl. No.: 746,507

[22] Filed: Jun. 19, 1985

[51] Int. Cl.[4] ..... E03D 5/04; E03D 11/10; E03D 1/18

[52] U.S. Cl. ..... 4/408; 4/249; 4/338; 4/405; 4/436

[58] Field of Search ..... 4/408, 249, 407, 405, 4/338, 411, 436, 661, 250, 347; 251/229

[56] References Cited

U.S. PATENT DOCUMENTS

| | | | |
|---|---|---|---|
| 631,097 | 8/1899 | Solomon et al. | 4/250 |
| 920,928 | 5/1909 | Davis | 4/408 |
| 963,440 | 7/1910 | Hodgson | 4/250 |
| 997,448 | 7/1911 | Henn | 4/408 |
| 1,381,710 | 6/1921 | Krantz | 4/214 |
| 1,595,741 | 2/1923 | Sweeney | 4/250 |
| 1,603,749 | 10/1926 | Delorme | 4/408 |
| 3,056,142 | 10/1962 | Chin | 4/408 |
| 3,883,904 | 5/1975 | Wittman | 4/411 |

*Primary Examiner*—Henry K. Artis
*Attorney, Agent, or Firm*—Oltman and Flynn

[57] ABSTRACT

An automatic toilet flusher is designed for installation in conventional reservoir type toilets having an external flushing lever in front of the reservoir. The design is of utmost simplicity for minimal maintenance. It allows automatic flushing by the release of weight from a spring loaded seat, or manual operation. The design avoids dependence on rubbing against the outside of a porcelain reservoir for release means. A simple gravity pivot resets the device. The primary use is for disabled persons who are unable to operate a lever or for public bathrooms to ensure flushing after each use.

5 Claims, 8 Drawing Figures

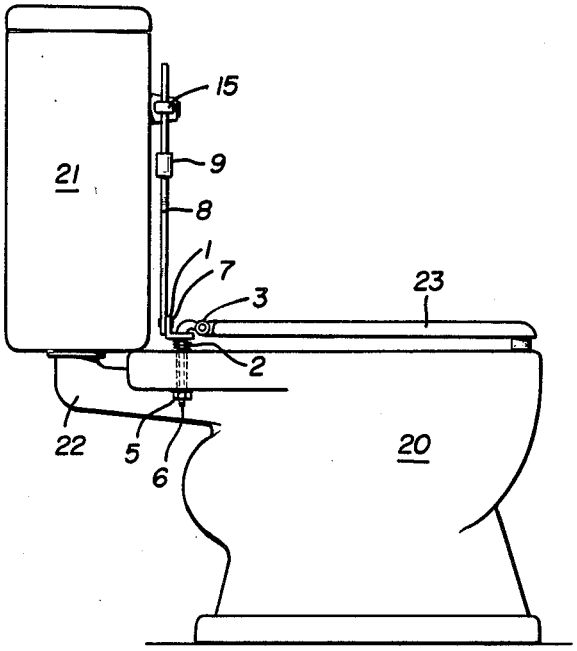
FIG. 2
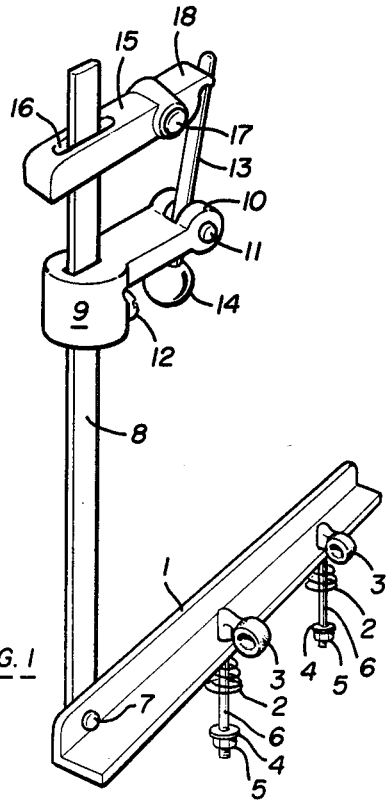
FIG. 1
FIG. 3
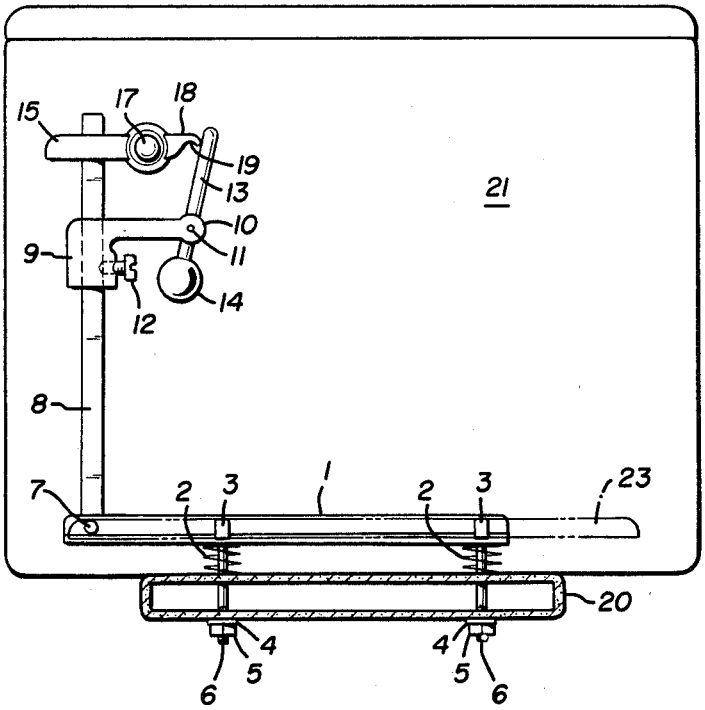

AUTOMATIC TOILET TANK RELEASE

BACKGROUND OF THE INVENTION

For almost a century numerous devices have had the object to provide automatic toilet flushing upon release of a spring loaded toilet seat. The primary use for such devices is to assist handicapped persons in flushing a toilet. Another primary use is to provide public toilets with automatic flushing means to improve sanitary conditions. Many disclosed devices have been quite complicated in construction and prone to breakdown. The worst designs allows water to leak in the event of breakdown.

The present invention is an improvement on the type of device which is readily adapted to a conventional reservior toilet having a forward facing external flushing lever. No moving contact is made with the porcelain reservior, thus providing longer life for an expensive part of a modern toilet.

SUMMARY OF THE INVENTION

The primary object of the present invention is to provide a toilet seat activated flushing means that is readily adaptable for installation either inside or outside of the water reservior. Using this invention, a toilet manufacturer or plumber can slightly modify a standard porcelain reservoir and enclose all the major parts inside. This prevents a more pleasing standard appearance and minimizes vandalism in public bathrooms.

The second object is to provide a simple, reliable, inexpensive means to connect a spring loaded toilet seat to a flushing lever in a manner that causes release of the seat after use to flush the toilet.

The third object is to provide for normal manual flushing by conventionally pushing the flushing lever.

The fourth object is to provide for a fully optional shifting from a manual to an automatic operation so the user need not worry about which mode he is using.

The means used to accomplish the objects listed above include a standard toilet seat which can be raised when the toilet is used for normal male urination without any way disturbing the inbuilt design function of the invention. The modification consists of mounting the standard toilet seat onto a horizontal bracket which is itself mounted on strong springs and attached by bolts through the standard toilet seat cover mounting holes found at the rear upper surface of a conventional toilet bowl. Thus, a person sitting on the toilet seat depresses the springs under the bracket which lowers the vertical rod which moves up or down based on the presence of weight of the toilet seat.

The rod is mounted to move in close proximity to either the inside or outside of the flushing lever. The flushing lever uses a unique design which extends its length several inches beyond the other side of its normal pivot. The extended portion has a notch cut into its lower surface at the tip. The horizontal portion of the notch tapers to a curve at the tip.

An actuating assembly is mounted near the top of the vertical rod which is attached to the toilet seat bracket. This actuating assembly is made up of an adjustable horizonal arm which can be stationed at the proper height on the rod. This horizonal arm has a pivot point and socket at its tip which is located directly under the notch of the modified flushing lever mentioned above.

The socket holds a pivoting vertical rod which completes the linkage from the toilet seat bracket up the primary vertical rod to the horizontal bracket to the secondary pivoted vertical rod to the notch of the flushing lever. The length of the secondary vertical rod in combination with the adjustment of the horizontal arm is set to activate the flushing lever when the toilet seat is released from the down to the up position. The tapering of the lever notch forces the secondary vertical rod to slip off and disengage the notch after flushing. The secondary rod remains in this disengaged position at all times when the toilet set is in the up position. Manual flushing can be done at this time. When the toilet seat is forced to the down position by human weight, the actuating assembly is pulled down and a counterweight at the base of the secondary rod causes the secondary rod to pivot into the flushing lever notch thus engaging the flushing lever in preparation for activating the flushing lever when the toilet seat resumes the up position.

Two embodiments comprise the basic invention. One is mounted inside and the other outside of the porcelain reservoir. The outside embodiment only requires replacing the conventional flushing lever with the unique lever as noted above. The rest of the invention is mounted on the outside of the toilet as noted above. No moving parts rub against the procelain toilet and reservoir assembly.

The inner mounted embodiment utilizes a unique flushing lever with both an outside handle and inside extension with the notch as noted above. A hole is provided at the base of the reservoir with a waterproof fitting housing the primary vertical rod. The horizontal toilet seat bracket is designed to reach under the reservoir and pull the primary vertical rod up and down as noted above.

Other objects of this invention will appear from the following description and appended claims, reference being had to the accompanying drawings forming a part of this specification wherein like reference characters designate corresponding parts in the several views.

BRIEF DESCRIPTION OF THE DRAWINGS

FIG. 1 shows a perspective view of all the major parts of the invention.

FIG. 2 shows a side elevational view of the invention mounted on the outside of a conventional toilet.

FIG. 3 shows a front view of a conventional toilet reservoir with the invention mounted on the outside and the activating means in the rest position with the toilet seat up.

DETAILED DESCRIPTION OF THE PREFERRED EMBODIMENTS

Figure 4:
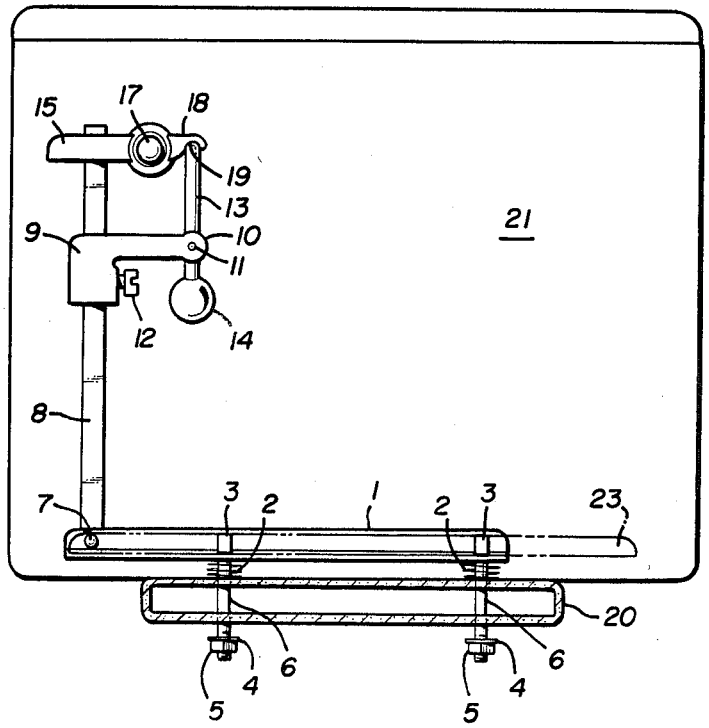
FIG. 4 is the same as FIG. 3 with the activating means in the ready position with the toilet seat down.

Referring first to FIG. 1, the horizonal bracket 1 rests on springs 2 which rest on the rear mounting holes for the lid on a conventional toilet (see FIG. 2). The bracket 1 has affixed thereto a pair of standard toilet seat holders 3 which form mounting bolts 6. Washers 4 and bolts 5 screw onto the bolts 6 to affix the bracket 1 to a toilet bowl (see FIG. 2). The bracket 1 moves up or down based on whether the weight of a person is pressed down on the toilet seat holder 3 by a toilet seat affixed thereon (see FIG. 2).

A primary vertical rod 8 is secured to bracket 1 at point 7 such that moving the bracket 1 up or down causes the primary vertical rod 8 to also move up or down. Affixed to the primary vertical rod 8 is actuating assembly 9. This assembly 9 may be adjusted to slide up or down primary vertical rod 8 and locked into position by set screw 12 for proper operation of the invention. Assembly 9 extends horizontally to socket 10 which has a pivot means 11 supporting secondary vertical rod 13. Secondary vertical rod 13 has a counterweight 14 at the lower end. Pivot means 11 are vertically aligned with the center of notch 19 which is at one end of flushing lever 15.

Flushing lever 15 pivots at point 17. Flushing lever 15 activates a linkage (not shown) which flushes a toilet (see FIG. 2) by means of a float valve (not shown) all of which is well known and forms no part of the present invention. A detailed explanation thereof is unnecessary in the present specification. Flushing lever 15 extends along length 18 and has a curved notch 19 at the end which is directly above pivot means 11.

The toilet is flushed either by manually depressing flushing lever 15 down in a conventional manner, or automatically as secondary vertical rod 13 pushes up on notch 19 as a person's weight is removed from bracket 1. Optional hole 16 serves as a guide for primary vertical rod 8. Other embodiments could use a separate bracket and vertical guide means (not shown).

Referring next to FIG. 2, a toilet water reservoir 21 holds water in preparation for flushing through pipe 22 into toilet 20 and out to drain (not shown). A standard toilet seat 23 is affixed to the invention by means of toilet seat holders 3. Bracket 1 is shown resting on springs 2 while bolts 5 firmly affix the invention to the toilet 20 by screwing onto bolts 6.

FIG. 3 shows the invention in the rest position after flushing and before anyone sits on the toilet seat (see FIG. 2). Secondary vertical rod 13, after having actuated the flushing lever 15 by pushing up on notch 19, has slipped out of the notch 19 thus disengaging from flushing lever 15.

FIG. 4 shows the invention in the ready position with weight on the toilet seat (see FIG. 2) pushing the toilet seat down and compressing springs 2. Bracket 1 is forced down by toilet seat holder 3 which in turn pulls down primary vertical arm 8 through connecting point 7. Arm 8 pulls actuator assembly 9 down which slides secondary arm 13 down into notch 19, with the assistance of counterweight 14 urging rod 13 to the left around pivot 11. The flushing lever 15 is held in position by the standard float valve flushing mechanism not shown and not part of this invention. The toilet 20 is now ready to be automatically flushed when the weight is removed from the toilet seat (see FIG. 2) thus allowing the springs 2 to activate the flushing lever 15 by means of the linkage formed by bracket 1, primary vertical rod 8, actuating assembly 9, secondary vertical rod 13 and notch 19.

Figure 5:
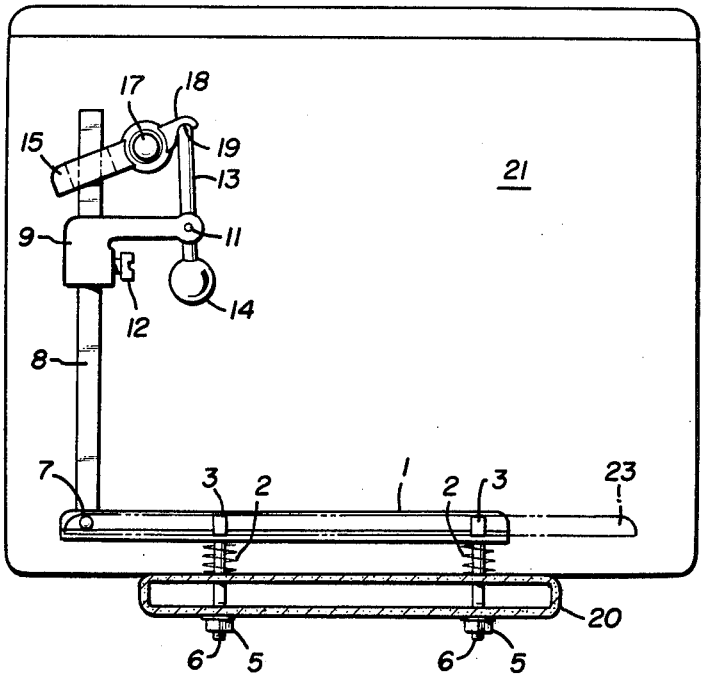
FIG. 5 is the same as FIG. 3 with the toilet flushing just before the toilet seat reaches the fully up position.

FIG. 5 shows the invention in a momentary position while secondary vertical rod 13 is actuating flushing lever 15. The springs 2 are almost fully extended after releasing their energy.

Figure 6:
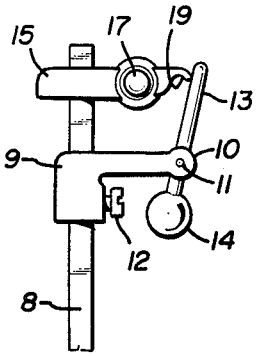
FIG. 6 shows the actuating assembly with the modified flushing lever.

FIG. 6 shows the secondary vertical rod in the rest position after slipping past notch 19. Actuating assembly 9 must be properly adjusted at installation by positioning at the height to allow a snug fit for arm 13 to seat into notch 19 at the vertical position. Set screw 12 is used to secure the actuating assembly 9 at the proper height along primary vertical arm 8.

Figure 7:
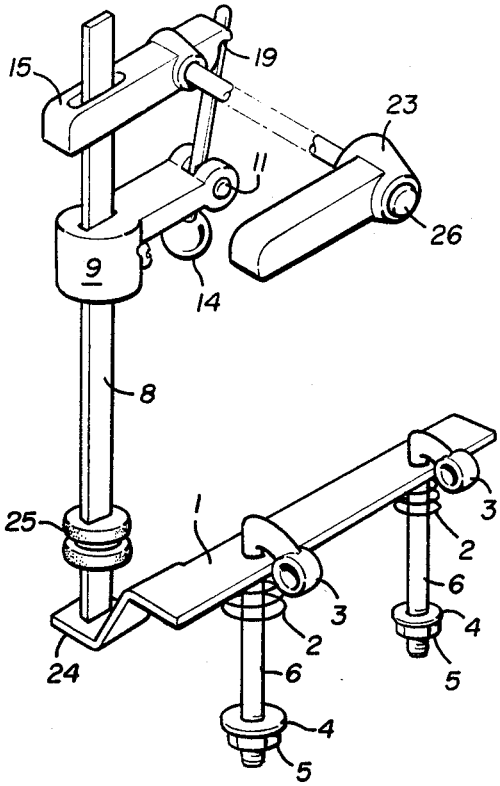
FIG. 7 shows a perspective view of an embodiment of the inside of the reservoir mounted invention.

FIG. 7 shows the invention in the inside the reservoir mounted embodiment. Bracket 1 has been modified to reach under the reservoir under the flushing lever 15 (see FIG. 8) by means of extension 24. Primary vertical arm 8 protrudes up through the bottom of the reservoir (see FIG. 8) through a waterproof fitting 25. All other parts of the invention are the same except flushing lever 15 has an extension 23 which is affixed on the outside of the reservoir (see FIG. 8) by screw means 26. Extension 23 is an external flushing lever for manual operation.

Figure 8:
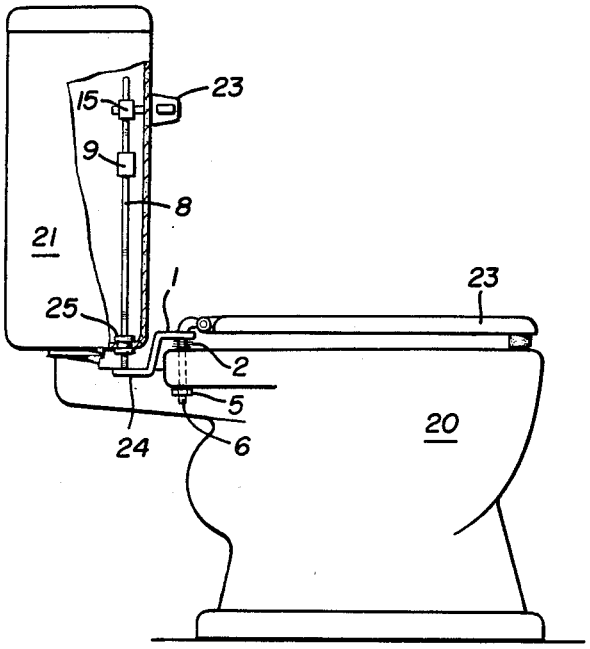
FIG. 8 is a side view of the invention mounted on the inside of a modified toilet.

FIG. 8 shows the inside mount embodiment installed on toilet 20 inside reservoir 21. Bracket 1 is secured the same as in the primary embodiment noted above. Extension 24 is shaped to reach from the side of bracket 1 under the flushing lever 15. Primary vertical rod 8 slides through waterproof fitting 25. Actuating assembly 9 can automatically activate flushing lever 15 as noted above or extension 23 can provide for manual operation.

I claim:

1. A toilet seat activated automatic flushing linkage functioning to automatically flush a reservoir type toilet when the user lifts his weight from said toilet seat comprising:

a toilet seat holder having springs mounted on said toilet wherein said springs exert upward pressure on said holder after a user removes his weight from said toilet seat;

a primary vertical rod affixed to said holder;

a vertical guide means for said primary vertical rod;

an actuating assembly affixed to said primary vertical rod further comprising a pivoting secondary vertical rod which has a counterweight at its lower tip;

a flushing lever working in cooperation with said actuating assembly.

2. The linkage of claim 1 wherein said secondary vertical rod is vertically aligned with said flushing lever such as to activate said flushing lever as vertical pressure is applied by said springs.

3. The linkage of claim 1 wherein said flushing lever consists of a center pivot, a manually operated handle and an extension opposite said manual handle which contains a downward facing notch, wherein said notch cooperates with said secondary vertical arm serving to engage said secondary vertical arm when vertical pressure is applied by said springs to accomplish flushing of said toilet, and after flushing serving to disengage said secondary vertical arm by allowing said secondary vertical arm to slip tangentially out of said notch, wherein upon a downward movement of said secondary vertical arm as caused by the lowering of said toilet seat holder, said secondary vertical arm, as urged by said counterweight, slips into said notch thereby engaging said linkage in preparation for automatic spring actuated flushing when the user removes his weight from said toilet seat.

4. The linkage of clam 3 wherein said primary vertical rod protrudes into the bottom of said toilet reservoir through a waterproof fitting, and said actuating assembly and said flushing lever are mounted inside said reservoir in the substantially similar manner as in claim 3, and said toilet seat holder functions to move said primary vertical rod up or down in the substantially similar manner as in claim 3.

5. The linkage of claim 4 wherein said flushing handle further comprises an extension handle outside said reservoir for manual operation.

* * * * *